US005476260A

United States Patent [19]

Ottley

[11] Patent Number: 5,476,260

[45] Date of Patent: Dec. 19, 1995

[54] TARGET GAME

[76] Inventor: David Ottley, 1175 Arrowhead Dr., West Chester, Pa. 19382

[21] Appl. No.: 198,110

[22] Filed: Feb. 17, 1994

[51] Int. Cl.[6] ..... A63F 7/00

[52] U.S. Cl. ..... 273/118 R; 273/127 R; 273/348; 273/410

[58] Field of Search ..... 273/108, 118 R, 273/127 R, 348, 410, 411, 400, 176 F, 176 FB, DIG. 26, 176 E, 176 R, 176 A; 206/459

[56] References Cited

U.S. PATENT DOCUMENTS

| | | | |
|---|---|---|---|
| 278,341 | 5/1883 | Kelly | 273/118 R |
| 922,717 | 5/1909 | Parker . | |
| 1,072,954 | 9/1913 | Junn . | |
| 1,248,970 | 12/1917 | Wilson-Hughes . | |
| 1,329,291 | 1/1920 | Chapman . | |
| 2,827,299 | 3/1958 | Dean | 273/176 F |
| 3,231,278 | 1/1966 | Boulanger | 273/118 R |
| 3,239,227 | 3/1966 | Roope . | |
| 3,393,913 | 7/1968 | Safina . | |
| 3,464,704 | 9/1969 | Nelson | 273/127 R |
| 3,580,578 | 5/1971 | McCarthy . | |
| 3,643,950 | 2/1972 | Holk . | |
| 3,741,544 | 6/1973 | Wolff, Jr. . | |
| 3,948,521 | 4/1976 | Warren . | |
| 4,017,085 | 4/1977 | Maxwell | 273/176 FA |
| 4,323,250 | 4/1982 | Lansberry . | |
| 4,352,497 | 10/1982 | Warehime . | |
| 4,511,148 | 4/1985 | Amos et al. . | |
| 4,805,916 | 2/1989 | Zentner, Jr. . | |
| 4,979,754 | 12/1990 | Eisenhart . | |
| 5,018,746 | 5/1991 | Cardoza, Jr. et al. . | |
| 5,171,016 | 12/1992 | Kamal | 273/176 FA |

*Primary Examiner*—Raleigh W. Chiu
*Attorney, Agent, or Firm*—Paul & Paul

[57] ABSTRACT

A target game for outdoor use wherein a ball is tossed or rolled toward a target with the target comprising a plurality of cups which are buried in the ground. Additionally, a backer board and rails are provided to accurately guide the ball in its path.

3 Claims, 3 Drawing Sheets

TARGET GAME

BACKGROUND OF THE INVENTION

1. Field of the Invention

This invention relates to an improved outdoor recreational activity. More particular, this invention relates to an improved target game.

2. Description of the Prior Art

Target games are well known in the art. The target game art generally consists of rolling, tossing or shooting various projectiles toward a target. The target itself usually consists of either various numbered rings or other scoring indicators, or of various pins or other objects which are knocked down. In the latter example, the rolling of a ball towards a series of numbered pins is the well known game commonly referred to as bowling. In the former example, target rifle shooting or archery are well known examples.

One such type of game seen in the art generally comprises a portable target which includes retained therein various scoring sectors. A ball or other missile is thrown in the direction of the target and, dependent upon the rules in place, the scoring is related to the various sectors in which the ball lands.

One problem, however, associated with such prior art target games is in its failure to provide for a simple, easily utilizable outdoor target game with minimal equipment. In particular, many such target games require rather extensive preparation which oftentimes is difficult and/or time consuming for some individuals, especially children. Still these and others comprise a number of separate, oftentimes distinctively shaped portions, which in many instances result in numerous problems with storage and transportation. Also, many other such target games can also be rather difficult in order to maintain proper operation; in particular, to keep working parts free of debris or other matter, thus limiting the applicable uses of the device. Further, these and others can also provide for rather complicated operation or otherwise use thereof, thus excluding children or other individuals from participation.

The present invention has been developed in view of the foregoing and to overcome the deficiencies of the prior art.

SUMMARY OF THE INVENTION

The present invention provides a target game which includes a plurality of cups or similar receptacles which comprise a target. These are buried or otherwise placed in dirt or sand some distance from the place where a player is to stand, kneel or sit. The targets can be laid out in any desired shape, such as a cross or sequential rows, or the triangular shape of bowling pins. The player is positioned behind a marked line and rolls or tosses a ball or similar implement towards the target. Scoring can take place in any of a variety of ways depending on the layout of the target and of the desires of the player. Additionally, guide rails extending from the player to the target, or a backing board positioned behind the target can also be provided in order to retain the ball within a confined playing area.

It is an object of the present invention to provide a target game for outdoor use.

Another object of the present invention is to provide a target game which can be easily transported and stored.

A further object of the present invention is to provide a target game which is simple to operate and durable in use.

These and other objects of the present invention will become more readily apparent from the following description.

DETAILED DESCRIPTION OF THE PREFERRED EMBODIMENTS

Figure 1:
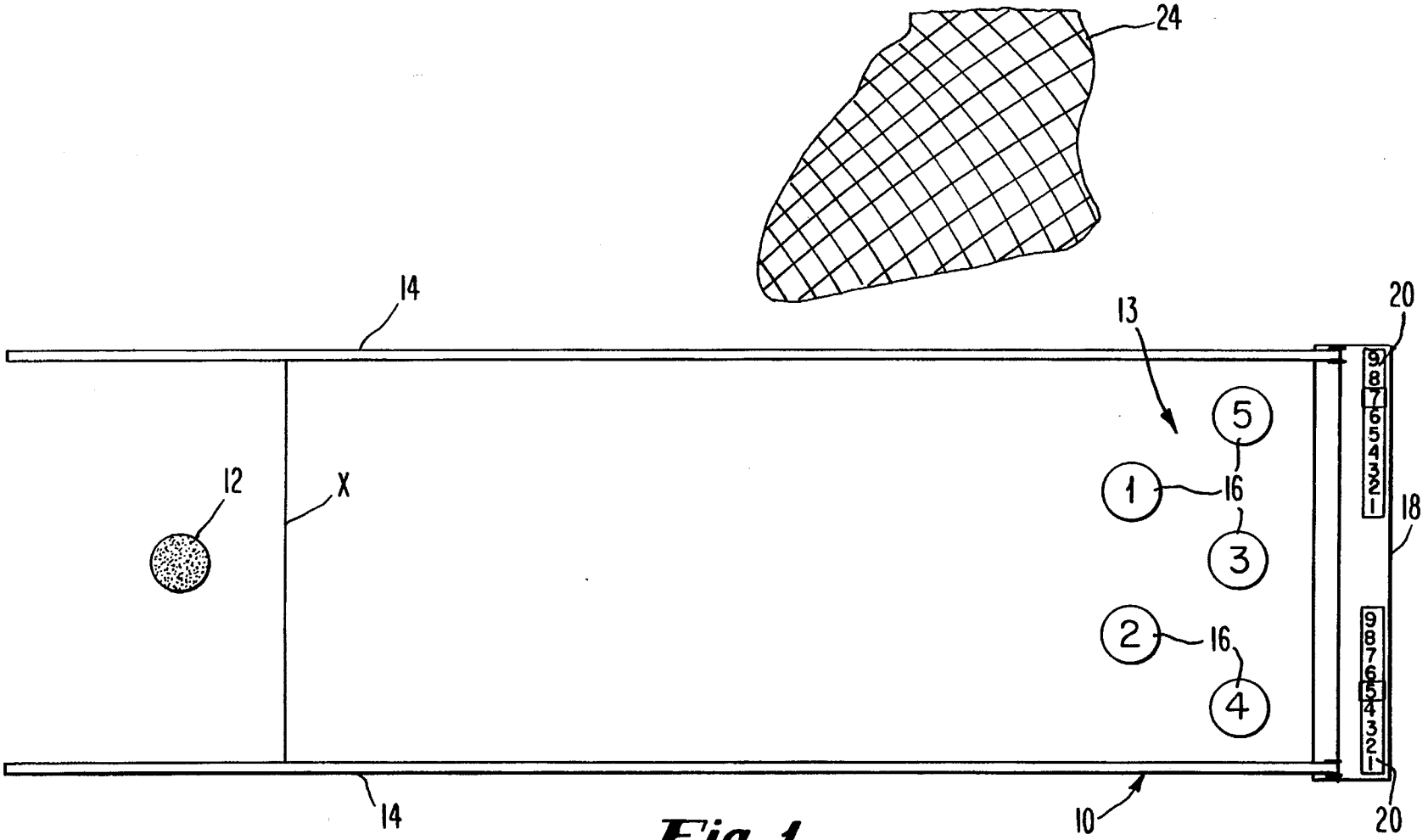
FIG. 1 is a top plan view of a target game according to a first embodiment of the present invention.

Referring to the drawings in detail, at FIG. 1 is seen a first embodiment of a target game 10 according to the present invention. The target game 10 as shown comprises a ball 12, which is held by a player (not shown) and rolled toward a target area seen generally at 13. Preferably, the player is positioned either standing, kneeling or sitting behind a designated starting line, where in FIG. 1 is identified as X. A pair of guide rails 14 are also preferably provided at spaced separation, generally parallel the other which operate to increase the accuracy of the ball 12. Generally, placement of the ball 12 in a plurality of cups 16, which is shown numbered 1 through 5 for illustration purposes, and provided within the target area 13, is the players goal. However, while the 5 cups 16 are shown in the present embodiment, it should be understood that any number of cups and placed in any arrangement can be provided without departing from the spirit of the present invention. For instance, the cups 16 can be numbered in any sequential fashion, such as in the manner shown in FIG. 3. For example, the player can take a number of turns, and each turn attempt to roll the ball in the higher numbered cup, assuming successful completion, i.e., placement of the ball in the targeted cup.

A backer board 18 is also provided which further serves to assist in targeting the ball; for instance, by way of rebounding the ball off its surface if the player so desires. Additionally, the backer board 18 can also be used as a mandatory rebounding aid, i.e., one the player must strike before the ball is successfully placed in the targeted cup.

Figure 2:
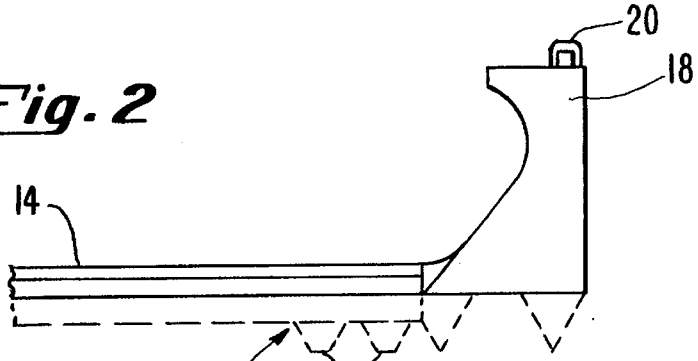
FIG. 2 is an elevational sectional view of the target area of FIG. 1.

At FIG. 2 is seen a sectional perspective view of the target area 13. The guide rails 14 are seen in phantom buried slightly in the ground for better stability. The guide rails 14 can be manufactured of any suitable material having sufficient flexibility, such as plastic, which permits rolling up at games end for easy transport and storage. Alternatively, the guide rails 14 can be provided as separate portions of any suitable material, which are adapted to be connected to one another for use. The cups 16 are also seen in phantom buried within the ground. The cups 16 can be manufactured of any number of plastics or other known in the art so as to be lightweight and transportable. Additionally, preferably the cups 16 are constructed in a manner to provide for ease of transportation and storage, such as to permit stacking one within the other as example.

The backer board 18 is preferably a plastic board of any of a number of types known in the art. The backer board 18 can also be provided as a number of separate portions connected by a hinge or other so as to be folded for transportation or storage, or otherwise can be manufactured thin enough to be rolled for the same purposes.

A scoring module 20 is best seen in FIG. 2. In the present embodiment, the module 20 consists of two scoring devices, which preferably are constructed in a chip on a rod fashion in a manner commonly known in the art, and contain a series of numbering thereon, for example numbers 1 through 100.

The scoring module 20 can be placed on the backer board 18 by placement of a channel formed along the underside of the scoring module 20 in a fashion shown in FIG. 2. Alternatively, each scoring device can be provided on corresponding guide rails 14. The scoring module 20 can be constructed of plastic or other lightweight material commonly known in the art.

The ball 12 is preferably constructed of plastic or of elastomeric material, such as rubber, in order to provide it with a sufficient density and resiliency to permit it to retain the direction imported on it by the player, as well as rebound predictably from the guide rails 14 and backer board 18. For example, a racquet ball of the type commonly known in the art can be utilized for this purpose, however, other means can also be used.

At set up, the board 18 preferably is pushed into the ground, such as sand or other surface, to a depth sufficient to afford it structural stability. Preferably, the backer board 18 includes posts 19 or similar extending outwardly from the bottom thereof which are received within the ground on installation, such as shown in phantom in FIG. 2. The scoring module 20 is then placed on top, with the channel being received over a projecting portion of the backer board 18, and in front of the board 18 holes are dug for the cups 16 in the desired arrangement. The cups 16 are then placed in the holes and the two guide rails 14 are placed or otherwise connected, by means commonly known in the art, on either side of the board 18, and then pushed to a sufficient depth so as to afford them structural stability for guiding and rebounding the ball 12.

One or a multiplicity of players may play the game. Each may take turns and try for placement of their balls in the cups. This can be done in a variety of different ways to afford various games; for example, each cup can be assigned a specific value and the player who scores highest after a predetermined number of turns wins. Further, as an alternative, the first player to complete a specific sequence of cups wins. It should be understood therefore that a number of different games can be played in accordance with the present invention. Other variations are throwing the ball rather than rolling; placing the cups in some other arrangement than that shown here; using alternative placement for alternative players so that, for example, player one may seek to place his ball or balls in cups numbered 1, 3 and 5 and player two may seek to place her ball or balls in cups numbered 2 and 4.

A container 24, such as a nylon mesh netting shown in FIG. 1 or similar can also be provided for transportation and storage of the target game. Furthermore, the container 24 preferably includes a series of holes therein, for instance, the mesh netting as seen in FIG. 1, which will allow the container to be emersed into a liquid, such as water so as to remove the dirt, sand and other matter from the target game pieces.

Figure 3:
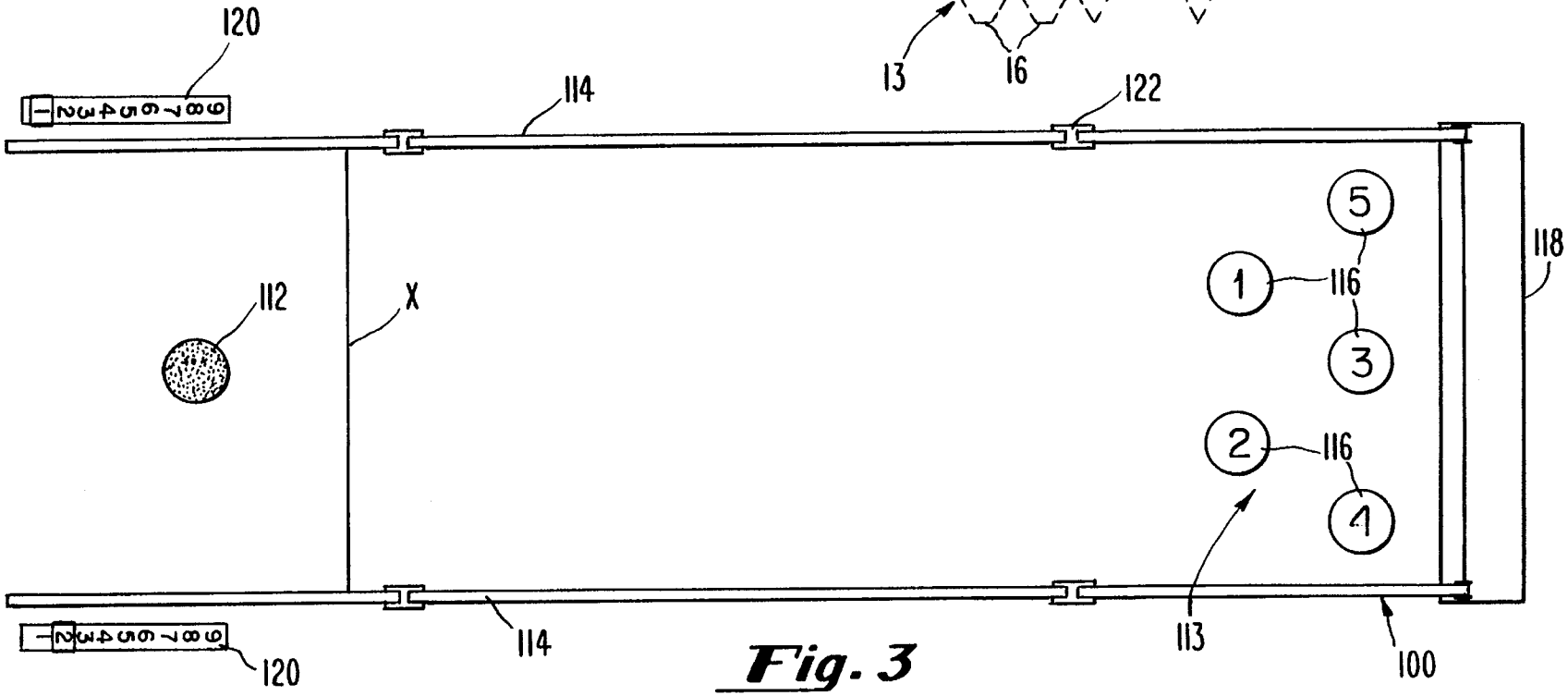
FIG. 3 is a top plan view of a target game according to a second embodiment of the present invention.
Figure 4:
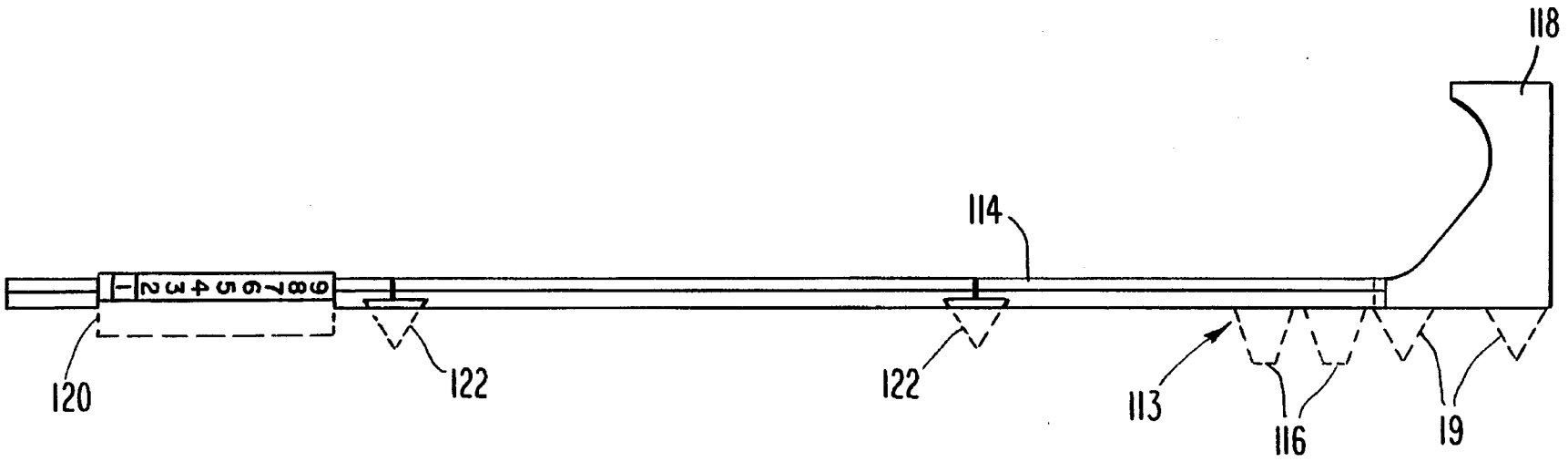
FIG. 4 is an elevational view of the target game of FIG. 3.

At FIGS. 3 and 4 is seen a second embodiment of the present invention. In this embodiment, each of the guide rails 114 are shown as 3 individual members adapted to be connected to one another for assembly. A clip 122 or other member, such as that shown, can be utilized for this purpose. The clip 122 as best seen in FIG. 4 is further provided with a projecting portion extending outwardly therefrom which is adapted to be received into the surface of the ground on installation. Furthermore, the guide rails 114 on assembly are adapted to slidably engage the backer board 104 to facilitate a fixed connection therebetween. Preferably, the guide rails 114 are formed having an aperture therein on an end thereof which is adapted to be inserted over a correspondingly configured lip provided within the backer board 18, as shown in phantom. It should be understood, however, that other methods can also be used for this purpose. The scoring module 120 as shown is included with a downwardly extending stud shown in phantom which is adapted to be received within the ground on assembly, preferably adjacent the guide rails 102 proximate the player.

All such modifications, improvements and alterations are to be understood as being within the scope of the present invention. It will be apparent that they may be made without departing from the scope. Accordingly, the invention is not limited by the embodiments but only by the scope of the appended claims.

I claim:

1. A method of using a portable beach game for use by at least one player, said portable beach game comprising:

a backer board comprising a generally elongated member having top and bottom sections, and front and back surfaces; a pair of rail members connectable by first ends thereof with said backer board, wherein each rail member comprises a generally elongated member and said rail members are releasably connectable with the front surface of said backer board by said first ends, said rail members define an opening extending between its second ends free from connection;

a scoring member provided on at least one of said rail members;

at least one substantially cylindrical receptacle defining an upper surface, a body and a lower surface, with a cavity being provided within said body at least extending through said upper surface;

at least one ball member; said method comprising the steps of;

placing said backer board directly onto the sand;

connecting said pair of rail members and said backer board, with said rail members being positioned directly onto the sand, and said rail members and backer board defining a predetermined playing area;

burying said substantially cylindrical receptacle in said sand below the surface of the sand so that the upper surface of the receptacle is flush with the surface of the sand;

positioning said player outside of the predetermined playing area;

rolling or tossing said ball member by said player into the predetermined playing area for capture by said cavity of said receptacle, wherein said backer board and said pair of rail members confine said ball member within the predetermined playing area.

2. A method according to claim 1, wherein said portable beach game further includes a plurality of substantially cylindrical receptacles, arranged in a predetermined fashion in said sand, wherein each receptacle is designated by a defined value, said method further including the steps of: rolling or tossing said ball by said player for capture by one of said plurality of receptacles; and scoring said game by adding the defined value of the receptacle into which the ball is captured to a player's score.

3. A method according to claim 2, wherein said portable beach game further includes a carrier member and said method further includes the step of:

disconnecting the rail members from the backer board and placing said rail members, backer board, receptacles, scoring member and ball member into said carrier member for portable use.

* * * * *